US009810060B2

(12) United States Patent
Sherrill

(10) Patent No.: US 9,810,060 B2
(45) Date of Patent: Nov. 7, 2017

(54) CONTROLLING FORMATION TESTER PROBE EXTENSION FORCE

(75) Inventor: Kristopher V. Sherrill, Thousand Oaks, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 568 days.

(21) Appl. No.: 14/360,266

(22) PCT Filed: Jul. 2, 2012

(86) PCT No.: PCT/US2012/045242
§ 371 (c)(1),
(2), (4) Date: May 22, 2014

(87) PCT Pub. No.: WO2014/007799
PCT Pub. Date: Jan. 9, 2014

(65) Prior Publication Data
US 2014/0311234 A1 Oct. 23, 2014

(51) Int. Cl.
*E21B 49/10* (2006.01)
*E21B 49/00* (2006.01)
*E21B 44/06* (2006.01)

(52) U.S. Cl.
CPC ..... *E21B 49/00* (2013.01); *E21B 44/06* (2013.01); *E21B 49/10* (2013.01)

(58) Field of Classification Search
CPC ..... E21B 49/10; E21B 44/06
See application file for complete search history.

(56) References Cited

U.S. PATENT DOCUMENTS

| | | | |
|---|---|---|---|
| 4,434,653 | A | 3/1984 | Montgomery |
| 4,845,982 | A | 7/1989 | Gilbert |
| 4,860,580 | A | 8/1989 | DuRocher |
| 4,884,439 | A | 12/1989 | Baird |
| 5,353,637 | A | 10/1994 | Plumb et al. |

(Continued)

FOREIGN PATENT DOCUMENTS

| | | |
|---|---|---|
| GB | 1449857 A | 9/1976 |
| WO | 9400671 | 1/1994 |

(Continued)

OTHER PUBLICATIONS

International Search Report and Written Opinion dated Mar. 8, 2013 for PCT Patent Application No. PCT/US2012/045242, 12 pages.

(Continued)

*Primary Examiner* — Paul West
(74) *Attorney, Agent, or Firm* — Chamberlain Hrdlicka

(57) ABSTRACT

A formation tester for use in a subterranean well can include a probe which extends outward into contact with an earth formation, and an adjustable flow control device which limits an extension pressure applied to extend the probe. A method of testing a subterranean formation can include positioning a formation tester in a wellbore, extending a probe of the formation tester outward into contact with the formation, and limiting a force applied by the probe to the formation, the limiting being performed by variable actuation of a flow control device downhole. Another formation tester can include a probe which extends outward into contact with an earth formation, with a force applied by the probe to the formation being remotely adjustable downhole.

33 Claims, 5 Drawing Sheets

(56) References Cited

U.S. PATENT DOCUMENTS

| | | | | |
|---|---|---|---|---|
| 7,729,861 | B2 | 6/2010 | Niemeyer et al. | |
| 2004/0011525 | A1* | 1/2004 | Jones | E21B 17/1014 166/264 |
| 2005/0235745 | A1 | 10/2005 | Proett et al. | |
| 2008/0115575 | A1* | 5/2008 | Meek | E21B 17/10 73/152.24 |

FOREIGN PATENT DOCUMENTS

| | | | |
|---|---|---|---|
| WO | 2005114134 | | 12/2005 |
| WO | 2008008424 | A2 | 1/2008 |

OTHER PUBLICATIONS

Halliburton, "GeoTap® Formation Pressure Tester", specification brochure, dated Oct. 2011, H03389, 2 pages.
Halliburton, "Sperry Drilling MWD/LWD Services", article, dated Jul. 2010, H07333, 8 pages.
Baker Hughes, "TesTrak LWD: Formation pressure while drilling", article, dated 2010, 30043 T, 6 pages.
Schlumberger, "StethoScope 675", specification brochure, dated 2009, 09-DR-0267, 2 pages.
Schlumberger, "StethoScope", article, dated 2008, 07-DR-280, 3 pages.

* cited by examiner

CONTROLLING FORMATION TESTER PROBE EXTENSION FORCE

TECHNICAL FIELD

This disclosure relates generally to equipment utilized and operations performed in conjunction with a subterranean well and, in one example described below, more particularly provides for controlling an extension force of a formation tester probe.

CROSS-REFERENCE TO RELATED APPLICATION

This application is a national stage under 35 USC 371 of International Application No. PCT/US12/45242, filed on 2 Jul. 2012. The entire disclosure of this prior application is incorporated herein by this reference.

BACKGROUND

Formation testers are used to determine properties of earth formations penetrated by wellbores. Typically, a probe is extended outward from a formation tester in a wellbore, so that the probe contacts and seals against a formation.

Unfortunately, insufficient force may be applied to the probe to obtain a seal against the formation (e.g., where the formation is relatively hard), or excessive force may be applied to the probe, thereby damaging the formation (e.g., where the formation is relatively soft). Therefore, it will be readily appreciated that improvements are continually needed in the art of constructing formation testers.

DETAILED DESCRIPTION

Figure 1:
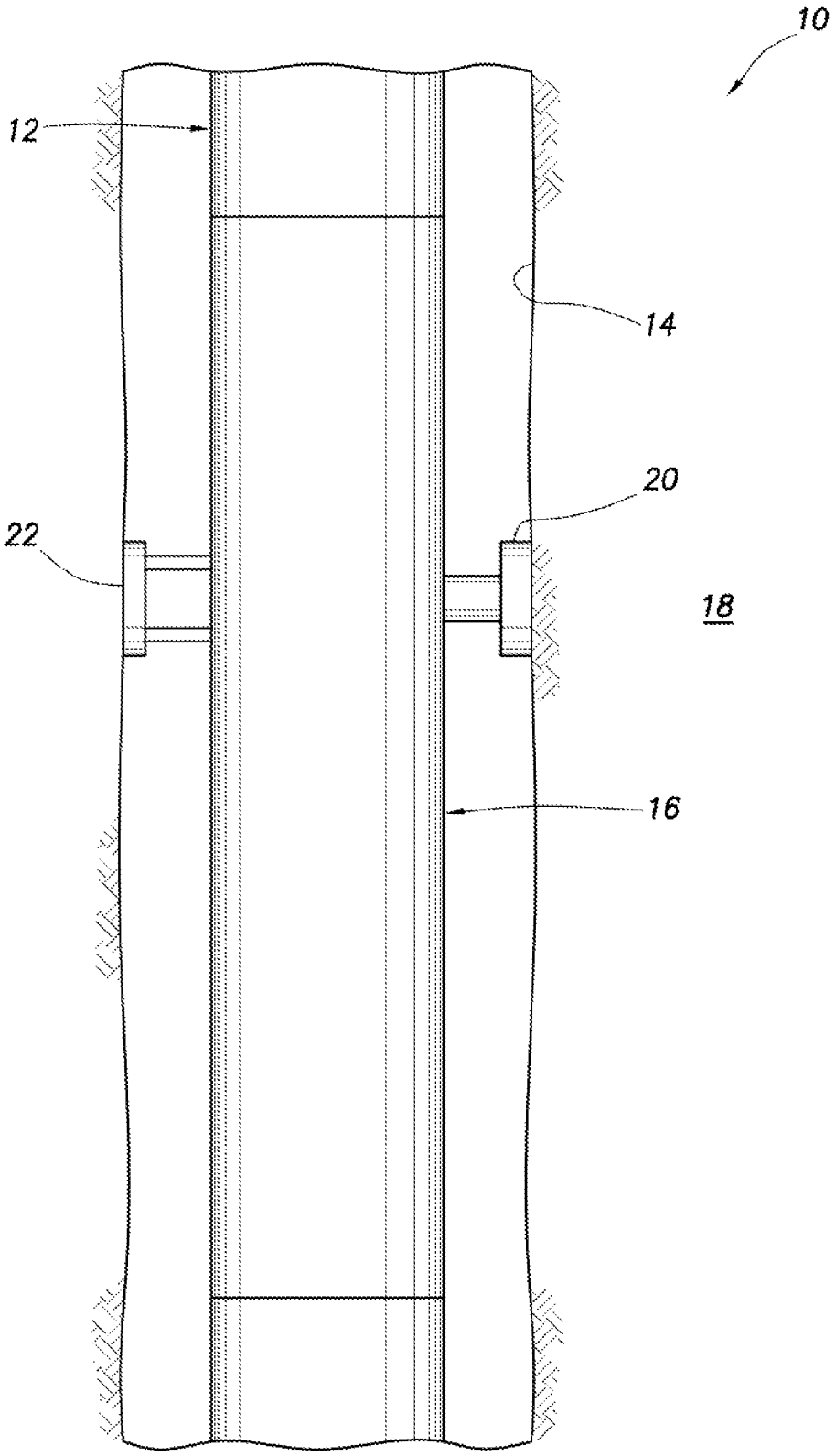
FIG. 1 is a representative partially cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is installed in a wellbore 14. The tubular string 12 could be a drill string, a drill stem test string, a coiled tubing string, or any other type of tubular string.

A formation tester 16 is interconnected in the tubular string 12. The formation tester 16 is used to test certain properties of an earth formation 18 penetrated by the wellbore 14. The formation 18 may be tested during drilling of the wellbore 14, or after the wellbore has been drilled.

A pad or probe 20 is extended outward from the formation tester 16 into contact with the formation 18. In this example, it is desired for the probe 20 to make sealing contact with the formation 18, so that fluid from the formation can be drawn into the formation tester 16 for analysis, sampling, etc.

Sufficient force is preferably applied to the probe 20, so that it seals effectively against the formation 18. This will enhance the accuracy of pressure measurements (for example, in pressure drawdown and buildup tests), and will prevent contamination of fluid samples drawn from the formation 18 into the formation tester 16.

However, the force applied by the probe 20 to the formation 18 is also preferably limited, so that the formation is not damaged. This is especially important in situations where the formation 18 is unconsolidated and relatively soft.

Unfortunately, the properties of the formation 18 are not always known with certainty prior to deploying a formation tester. For this reason and others, the formation tester 16 is preferably provided with a way of limiting the force applied by the probe 20 to the formation 18. In some examples described below, the force applied by the probe 20 to the formation 18 can be adjusted downhole, such as, in response to certain properties of the formation being detected, in response to detection of contact between the probe and the formation, in response to detection of the probe extension ceasing, or in response to a sudden increase in pressure applied to extend the probe.

However, it should be clearly understood that the operation of the formation tester 16 is not limited to only the above techniques of adjusting the force applied by the probe 20 to the formation 18. Instead, any manner of adjusting the force applied by the probe 20 to the formation 18 may be used in keeping with the principles of this disclosure.

In the FIG. 1 example, a backup pad or shoe 22 is used to react the force applied by the probe 20, and to maintain the formation tester 16 somewhat centered in the wellbore 14. However, use of the backup shoe 22 is not necessary.

Figure 2:
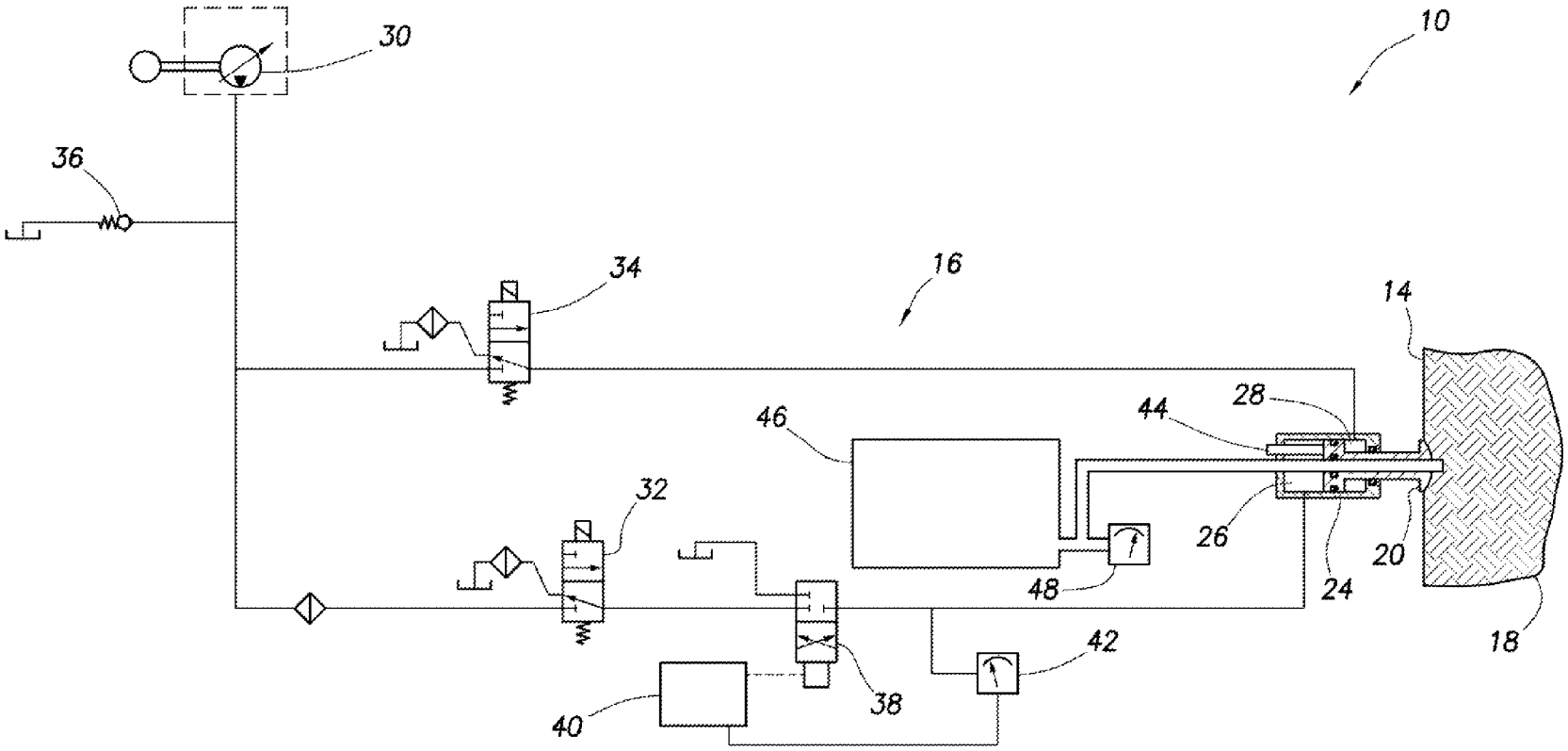
FIG. 2 is a representative hydraulic schematic for a formation tester which may be used in the system and method of FIG. 1, and which can embody principles of this disclosure.

Referring additionally now to FIG. 2, a hydraulic schematic for the formation tester 16 is representatively illustrated. The formation tester 16 example depicted in FIG. 2 may be used in the system 10 and method of FIG. 1, or it may be used in other systems or methods.

In FIG. 2 it may be seen that the probe 20 is extended and retracted by application of pressure differentials across a piston 24 connected to the probe. Increased pressure is applied to a chamber 26 in order to extend the probe 20 outward from the formation tester 16, and increased pressure is applied to a chamber 28 in order to retract the probe.

A pump 30 and solenoid valves 32, 34 are used to apply the increased pressure to the chamber 26, or to the chamber 28. A relief valve 36 prevents the pump 30 from applying excessive pressure to either of the chambers 26, 28.

The force applied by the probe 20 to the formation 18 is directly proportional to the extension pressure applied to the chamber 26. Thus, the force applied by the probe 20 can be controlled by controlling the extension pressure.

For this purpose, the formation tester 16 includes a flow control device 38 which can be actuated to relieve pressure from the chamber 26. The flow control device 38 is depicted in FIG. 2 as being a servo-controlled valve, but other types of flow control devices may be used, if desired.

The flow control device 38 may be actuated remotely (e.g., via commands transmitted from a remote location, such as the earth's surface or a sea floor location, etc.). For this purpose and others, the tubular string 12 may include provisions for wired or wireless telemetry (e.g., acoustic, electromagnetic, optical, electrical, pressure pulse or any other type of telemetry).

Alternatively, if the pertinent properties (e.g., compressive strength, etc.) of the formation 18 are known beforehand, then the flow control device 38 may be adjusted at the surface, so that it will limit the maximum pressure applied to the chamber 26 downhole. A controller 40 (such as, a programmable logic controller) may be used for making this adjustment.

If the pertinent properties of the formation 18 are unknown prior to use of the formation tester 16, then the properties of the formation as measured by the formation tester (or other sensors in the tubular string, such as logging-while-drilling sensors, etc.) may be used for adjusting the operation of the flow control device 38 downhole. For example, the probe 20 could be displaced outward into contact with the formation 18, at which time a measurement of the formation properties can be made (e.g., by relating the force applied by the probe to a displacement of the probe (or a "stinger" on an end of the probe) into the formation). Any manner of determining levels of pertinent properties of the formation 18 may be used in keeping with the scope of this disclosure.

The measured formation 18 property can then be used to adjust the maximum pressure permitted to be applied to the chamber 26 by the flow control device 38. That is, the flow control device 38 can prevent pressure greater than a maximum limit from being applied to the chamber 26.

A pressure sensor 42 can be used to measure the pressure applied to the chamber 26. A displacement or position sensor 44 can be used to measure the displacement of the piston 24 and probe 20. Additional or different sensors may be used in the formation tester 16, in keeping with the principles of this disclosure.

It is contemplated that a relatively sudden increase in pressure will be measured by the sensor 42 when the probe 20 contacts the formation 18. This will be due to the fact that displacement of the probe 20 is suddenly resisted when the probe contacts the formation 18.

Thus, the pressure increase can be used as an indication that the probe 20 has contacted the formation 18. At this point, the controller 40 can operate the flow control device 38 to prevent further pressure from being applied to the chamber 26.

In this manner, the probe 20 will be extended outward into sealing contact with the formation 18, but the probe will not be displaced further into the formation. For example, the pressure applied to the chamber 26 could be monitored while the probe 20 is being displaced outward and, when the pressure increases at or above a predetermined rate, the controller 40 can operate the flow control device 38 to limit the pressure applied to the chamber (e.g., allowing no further pressure to be applied to the chamber).

It is also contemplated that a rate of displacement of the probe 20 will suddenly decrease when the probe contacts the formation 18. As with the pressure increase discussed above, this decreased displacement rate will be due to the fact that displacement of the probe 20 is suddenly resisted when the probe contacts the formation 18. The probe's displacement and sudden slowing will be measured by the sensor 44.

Thus, the decrease in the rate of displacement can be used as an indication that the probe 20 has contacted the formation 18. At that point, the controller 40 can operate the flow control device 38 to prevent further pressure from being applied to the chamber 26.

In this manner, the probe 20 will be extended outward into sealing contact with the formation 18, but the probe will not be displaced further into the formation. For example, the outward displacement of the probe 20 can be monitored and, when the rate of displacement suddenly decreases, the controller 40 can operate the flow control device 38 to limit the pressure applied to the chamber (e.g., allowing no further pressure to be applied to the chamber).

The variable operation of the flow control device 38 to correspondingly variably limit the pressure applied to the chamber 26 can be fully automatically controlled in the formation tester 16. Alternatively, an operator at a remote location can provide the controller 40 with a maximum pressure set point based, for example, on the pertinent properties of the formation 18, on the pressure increase when the probe 20 contacts the formation, or on the displacement decrease when the probe contacts the formation. In response, the controller 40 can variably operate the flow control device 38 as needed to prevent the maximum pressure set point from being exceeded.

After the probe 20 has been extended into sealing contact with the formation 18, fluid from the formation can be flowed through the probe into a fluid analysis/sampling system 46 of the formation tester 16. A suitable fluid analysis/sampling system for use in the formation tester 16 is provided in the GEO TAP™ IDS fluid identification and sampling system marketed by Halliburton Energy Services, Inc. of Houston, Tex. USA. Of course, other fluid analysis/sampling systems may be used in keeping with the principles of this disclosure.

In some examples, only pressure drawdown and buildup tests may be performed, and so the analysis/sampling system 46 may not be used. Instead, a pressure sensor 48 may be sufficient for these pressure drawdown and buildup tests.

Note that a sudden change in pressure as sensed by the sensor 48 can indicate when the probe 20 has sufficiently sealed against the formation 18. This is due to the fact that, prior to the probe 20 sealing against the formation 18, the sensor 48 is in communication with the wellbore 14, but after the probe is sealed against the formation, the sensor is in communication with the formation 18, and there is typically (but not always) a difference between wellbore pressure and formation pressure. If such a pressure change is detected by the sensor 48, the controller 40 can operate the flow control device 38 to prevent further pressure from being applied to the chamber 26.

Figure 3:
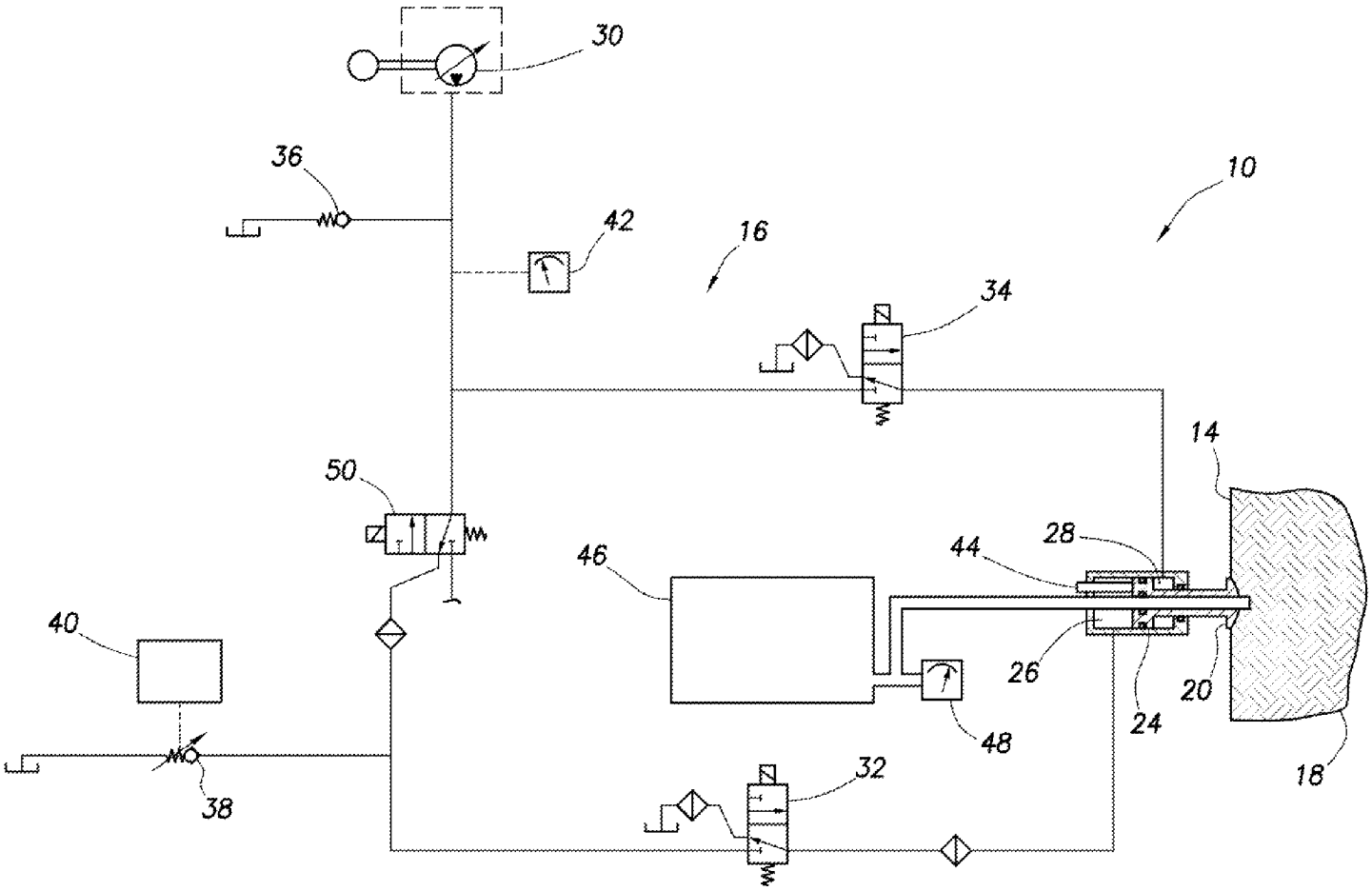
FIG. 3 is a representative hydraulic schematic for another example of the formation tester.

Referring additionally now to FIG. 3, another example of a hydraulic schematic for the formation tester 16 is representatively illustrated. This example is similar in many respects to the hydraulic schematic of FIG. 2, but differs at least in part in that the FIG. 3 hydraulic schematic depicts the flow control device 38 as an adjustable relief valve, instead of as a serve-controlled valve.

The flow control device 38 of FIG. 3 is adjustable by the controller 40. That is, the controller 40 can adjust a pressure at which the relief valve 38 will open and relieve pressure from the chamber 26. This adjustment may be made at the surface (for example, if the formation 18 properties are known beforehand), or the adjustment may be made after the formation tester 16 is positioned downhole (either automatically in response to detected parameters, or in response to commands transmitted from a remote location).

The FIG. 3 schematic also includes another solenoid valve 50. This valve 50 can be used to direct pressure from the pump 30 to elements of the formation tester 16 other than the chambers 26, 28. For example, pressure can be diverted to the fluid analysis/sampling system 46 for use in, e.g., actuating fluid samplers (not shown), etc.

Figure 4:
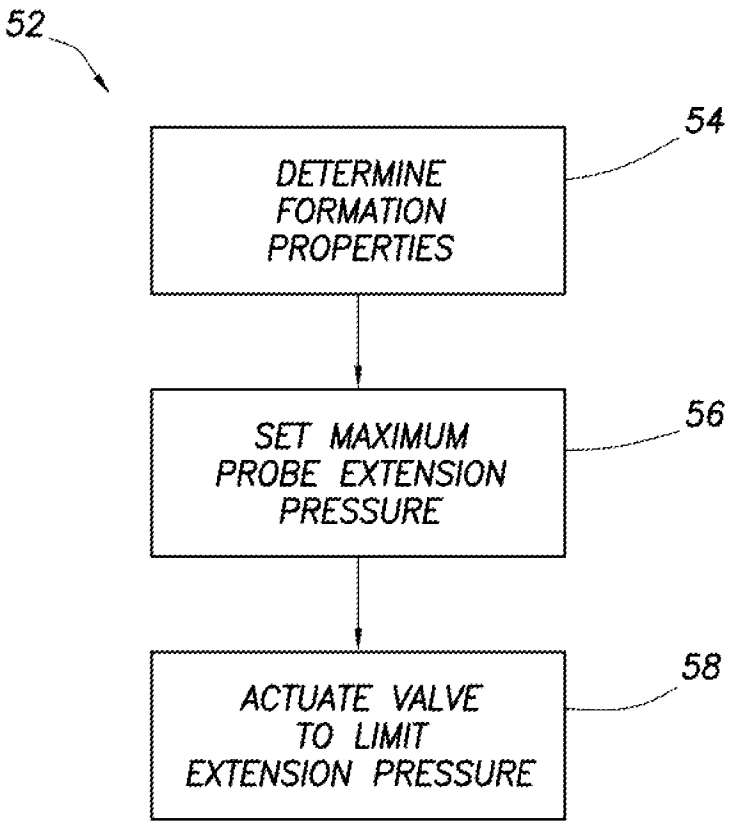
FIG. 4 is a representative flow chart for a method of testing a formation, which method can embody principles of this disclosure.

Referring additionally now to FIG. 4, a flowchart for a method 52 of testing a subterranean formation 18 is representatively illustrated in flowchart form. The method 52 may be practiced with the formation tester 16 described above, or it may be practiced with any other formation tester. The method 52 may be performed in the well system 10, or it may be performed in other well systems.

In step 54, relevant properties of the formation 18 are determined. This step 54 may be performed prior to, or after, the formation tester 16 is installed in the wellbore 14.

For example, offset well data could be used to determine the formation 18 properties prior to positioning the formation tester 16 in the wellbore 14. In that case, the flow control device 38 could be adjusted, prior to installing the formation tester 16, so that no more than a predetermined maximum force will be applied by the probe 20 to the formation 18. Prior to installation in the well, the controller 40 could be programmed to variably operate the flow control device 38 depicted in FIG. 2 so that no more than a maximum extension pressure is applied to the chamber 26 (as measured by the sensor 42), or the opening pressure of the flow control device 38 depicted in FIG. 3 could be adjusted so that the relief valve opens at the maximum extension pressure.

Alternatively, the relevant formation 18 properties may be determined after the formation tester 16 is positioned in the wellbore 14. For example, the formation 18 properties may be determined using the formation tester 16 itself (e.g., monitoring displacement of the probe 20 versus pressure applied to the chamber 26, properties determined using the analysis/sampling system 46, etc.), or using other downhole sensors (such as, logging-while-drilling sensors, etc.).

In step 56, the maximum probe 20 extension pressure is set. As discussed above, this maximum extension pressure corresponds to a maximum force to be applied by the probe 20 to the formation 18.

The maximum extension pressure may be set in any of a variety of different ways. For example, if the maximum extension pressure can be set prior to installing the formation tester 16, then an operator can program the controller 40 or adjust the flow control device 38 as appropriate to prevent the maximum extension pressure from being exceeded.

If the maximum extension pressure is to be set after the formation tester 16 is installed in the wellbore 14, then this step may be performed automatically or in response to commands transmitted from a remote location. For example, the controller 40 could monitor the chamber 26 pressure and/or the sensor 44 output, and could limit the chamber 26 pressure (e.g., prevent further pressure increase) when a sudden pressure increase and/or displacement rate decrease is detected.

In step 58, the flow control device 38 is variably actuated as needed to limit the extension pressure. In the FIG. 2 example, the flow control device 38 is opened by the controller 40 when the sensor 42 indicates that the maximum extension pressure is exceeded. In the FIG. 3 example, the controller 40 adjusts the opening pressure of the flow control device 38, so that the maximum extension pressure will not be exceeded. These are just two examples of techniques that may be used to vary operation of a flow control device, so that pressure in the chamber 26 does not exceed a certain maximum. However, other techniques and other types of flow control devices may be used, without departing from the scope of this disclosure.

Note that the force applied by the probe 20 to the formation 18 is related to a pressure differential across the piston 24, instead of strictly to the pressure applied to the chamber 26 (since pressure in the other chamber 28 could reduce the force output by the piston 24). Thus, the maximum extension pressure discussed above is, in the examples of FIGS. 2 & 3, a maximum differential pressure from the chamber 26 to the chamber 28.

Figure 5:
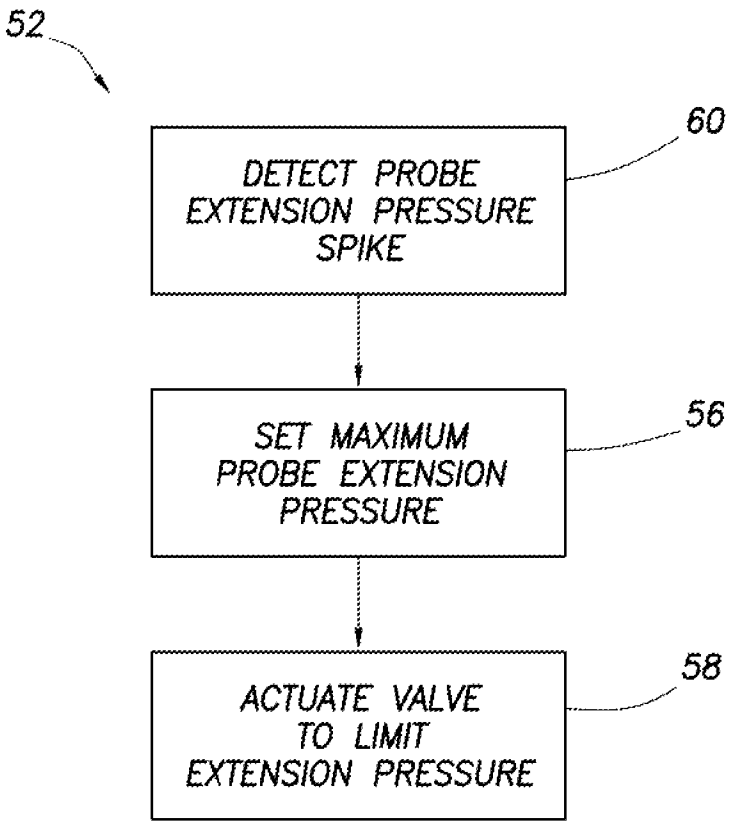
FIG. 5 is a representative flow chart for another example of the method of testing a formation.

Referring additionally now to FIG. 5, another example of the method 52 of testing a formation 18 is representatively illustrated in flowchart form. The FIG. 5 method 52 is similar in most respects to the method of FIG. 4, but differs in that an extension pressure "spike" (rapid increase) is detected in a step 60 of the FIG. 5 method. The extension pressure spike is due to the probe 20 contacting the formation 18.

Steps 56 and 58 are substantially the same as those described above for the FIG. 4 method 52, but in the method of FIG. 5 the maximum probe extension pressure is set based on the detection of the extension pressure spike in step 60. Thus, the controller 40 adjusts the flow control device 38, or variably operates the flow control device, to prevent the extension pressure from exceeding the set maximum, in response to the extension pressure spike being detected.

For example, the controller 40 could adjust the flow control device 38 or variably actuate the flow control device, so that the extension pressure going forward does not exceed the measured extension pressure just prior to the spike occurring. Alternatively, the controller 40 could adjust the flow control device 38 or variably actuate the flow control device, so that the extension pressure going forward does not exceed the measured extension pressure just prior to the spike plus a predetermined or calculated offset (e.g., so that sufficient contact pressure is applied to effect sealing of the probe 20 against the formation 18, etc.).

Figure 6:
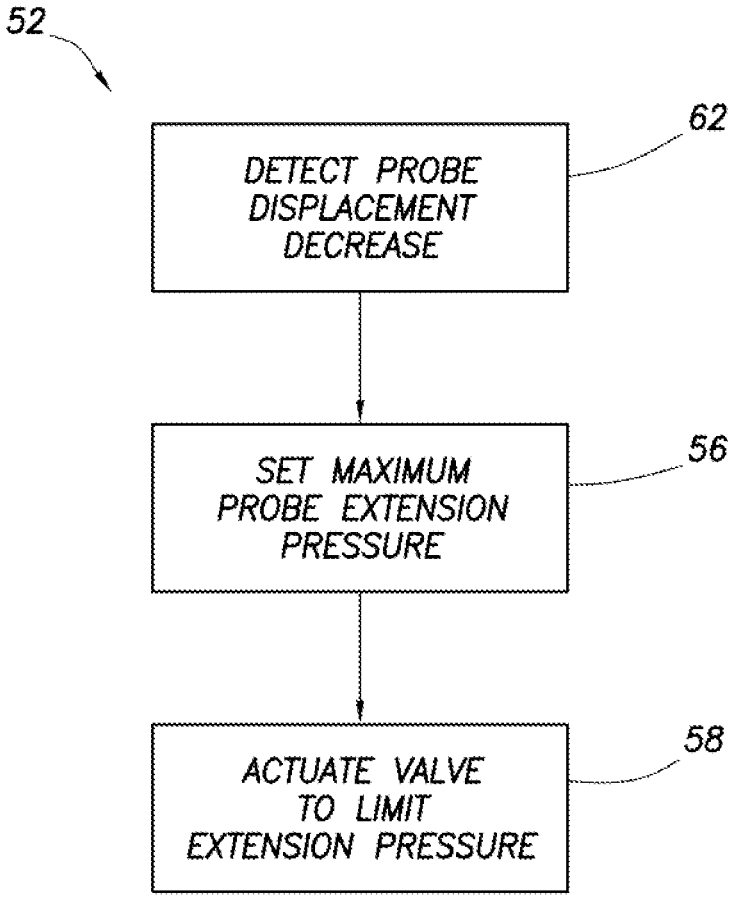
FIG. 6 is a representative flow chart for yet another example of the method of testing a formation.

Referring additionally now to FIG. 6, another example of the method 52 of testing a formation 18 is representatively illustrated in flowchart form. The FIG. 6 method 52 is similar in most respects to the methods of FIGS. 4 & 5, but differs in that a decrease in a rate of displacement is detected in a step 62 of the FIG. 6 method. The decrease in the rate of displacement is due to the probe 20 contacting the formation 18.

Steps 56 and 58 are substantially the same as those described above for the FIGS. 4 & 5 methods 52, but in the method of FIG. 6 the maximum probe extension pressure is set based on the detection of the displacement rate decrease in step 62. Thus, the controller 40 adjusts the flow control device 38, or variably operates the flow control device, to prevent the extension pressure from exceeding the set maximum, in response to the displacement rate decrease being detected.

For example, the controller 40 could adjust the flow control device 38 or variably actuate the flow control device, so that the extension pressure going forward does not exceed the measured extension pressure just prior to the displacement rate decrease occurring. Alternatively, the controller 40 could adjust the flow control device 38 or variably actuate the flow control device, so that the extension pressure going forward does not exceed the measured extension pressure just prior to the displacement rate decrease occurring plus a predetermined or calculated offset (e.g., so that sufficient contact pressure is applied to effect sealing of the probe 20 against the formation 18, etc.).

It may now be fully appreciated that the above disclosure provides significant advancements to the art of formation testing. In examples described above, a force applied by the probe 20 to the formation 18 can be conveniently controlled. The controlling can be based on a variety of factors, including levels of pertinent properties of the formation 18, and detection of contact between the probe 20 and the formation.

A formation tester 16 for use in a subterranean well is described above. In one example, the formation tester 16 can include a probe 20 which extends outward into contact with an earth formation 18, and an adjustable flow control device 38 which limits an extension pressure applied to extend the probe 20.

The flow control device 38 may be remotely adjustable in the well.

The flow control device 38 may limit the extension pressure in response to detection of contact between the probe 20 and the formation 18.

The flow control device 38 may limit the extension pressure in response to an increase in the extension pressure, which increase indicates contact between the probe 20 and the formation 18. The flow control device 38 may limit the extension pressure in response to a change in pressure sensed through the probe 20, which change indicates contact between the probe 20 and the formation 18.

The flow control device 38 may limit the extension pressure in response to a level of a property of the formation 18. For example, if the formation 18 is more consolidated, has an increased compressive strength or is harder, the maximum extension pressure may be increased, and if the formation is more unconsolidated, has a reduced compressive strength or is softer, the maximum extension pressure may be decreased. The level of the formation 18 property may be determined downhole. The formation tester 16 may measure the level of the formation 18 property downhole.

The formation tester 16 may include a controller 40 which controls operation of the flow control device 38. The controller 40 may limit the extension pressure in response to detection of contact between the probe 20 and the formation 18. The controller 40 may limit the extension pressure based on a level of a property of the formation 18. The controller 40 may limit the extension pressure when a rate of displacement of the probe 20 decreases.

A method 52 of testing a subterranean formation 18 is also described above. In one example, the method 52 comprises: positioning a formation tester 16 in a wellbore 14; extending a probe 20 of the formation tester 16 outward into contact with the formation 18; and limiting a force applied by the probe 20 to the formation 18, the limiting step being performed by variable actuation of a flow control device 38 downhole.

The flow control device 38 variable actuation can be performed after the formation tester 16 is positioned in the wellbore 14. Alternatively, the flow control device 38 or controller 40 can be adjusted or varied prior to installing the formation tester 16.

Actuation of the flow control device 38 may limit an extension pressure applied to extend the probe 20.

The flow control device 38 may be remotely adjustable in the wellbore.

The flow control device 38 may limit the force in response to detection of contact between the probe 20 and the formation 18, in response to an increase in the force (which increase indicates contact between the probe 20 and the formation 18), and/or in response to a level of a property of the formation 18.

Another formation tester 16 example is described above for use in a subterranean well. In this example, the formation tester 16 includes a probe 20 which extends outward into contact with an earth formation 18. A force applied by the probe 20 to the formation 18 is remotely adjusted downhole.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A formation tester for use in a well located in a subterranean formation, comprising:

a probe extendable within the well to contact the formation;

a piston connected to the probe and positioned with a housing comprising first and second chambers separated by the piston;

a pump coupled to and in fluid communication with the first and second chambers;

an adjustable flow control device coupled between and in fluid communication with the pump and the first chamber, wherein the adjustable flow control device comprises a servo-controlled valve and is configured to limit an extension pressure applied to extend the probe; and a position sensor configured to measure a displacement rate of the probe.

2. The formation tester of claim 1, wherein the adjustable flow control device is remotely adjustable in the well.

3. The formation tester of claim 1, wherein the adjustable flow control device is configured to limit the extension pressure in response to a decrease of the displacement rate of the probe by the position sensor, which decrease indicates contact between the probe and the formation.

4. The formation tester of claim 1, wherein the adjustable flow control device is configured to limit the extension pressure in response to an increase in the extension pressure, which increase indicates contact between the probe and the formation.

5. The formation tester of claim 1, further comprising a pressure sensor, wherein the adjustable flow control device is configured to limit the extension pressure in response to a change in pressure sensed through the probe by the pressure sensor, which change indicates contact between the probe and the formation.

6. The formation tester of claim 1, wherein the adjustable flow control device is configured to limit the extension pressure in response to a level of a property of the formation.

7. The formation tester of claim 1, further comprising a controller in communication with the adjustable flow control device and configured to control operation of the adjustable flow control device, and wherein the controller is configured to limit the extension pressure in response to detection of a decrease of the displacement rate of the probe by the position sensor.

8. The formation tester of claim 1, further comprising a controller in communication with the adjustable flow control device and configured to control operation of the adjustable flow control device, and wherein the controller is configured to limit the extension pressure based on a level of a property of the formation.

9. The formation tester of claim 1, further comprising a controller and a pressure sensor, wherein the controller is in communication with the adjustable flow control device and configured to control operation of the adjustable flow control device, and wherein the adjustable flow control device is configured to limit the extension pressure in response to a change in pressure sensed through the probe by the pressure sensor.

10. The formation tester of claim 1, wherein the position sensor is configured to measure the displacement rate of the piston.

11. The formation tester of claim 1, further comprising:

a first solenoid valve coupled between the pump and the adjustable flow control device;

a second solenoid valve coupled between the pump and the second chamber; and a relief valve coupled to the pump and configured to prevent the pump from applying an excessive pressure to the first and second chambers.

12. A method of testing a subterranean formation, comprising:

positioning a formation tester in a wellbore located in the formation;

extending a probe of the formation tester outward into contact with the formation, wherein the probe is connected to a piston positioned in a housing comprising first and second chambers separated by the piston, wherein the first and second chambers are coupled to and in fluid communication with a pump, and wherein the probe is extended by applying pressure to the piston via a first solenoid valve coupled between the pump and the first chamber;

measuring a displacement rate of the probe by a position sensor;

limiting a force applied by the probe to the formation by variably actuating a flow control device located downhole, wherein the flow control device is coupled between and in fluid communication with the pump and the first chamber;

retracting the probe by applying pressure to the piston via a second solenoid valve coupled between the pump and the second chamber.

13. The method of claim 12, further comprising variably actuating the flow control device after the formation tester is positioned in the wellbore.

14. The method of claim 12, wherein limiting the force applied by the probe further comprises limiting the pressure applied to extend the probe; and further comprising preventing the pump from applying an excessive pressure to the first and second chambers by a relief valve coupled to the pump.

15. The method of claim 12, further comprising remotely adjusting the flow control device in the wellbore, wherein the flow control device comprises a servo-controlled valve.

16. The method of claim 12, wherein the flow control device limits the force in response to a decrease of the displacement rate of the probe by the position sensor, which decrease indicates contact between the probe and the formation.

17. The method of claim 12, further comprising limiting the force applied by the probe in response to a change in pressure sensed through the probe, which change indicates contact between the probe and the formation.

18. The method of claim 12, further comprising measuring pressure with a pressure sensor, and wherein limiting the force applied by the probe further comprises actuating the flow control device in response to an increase in pressure sensed through the probe by the pressure sensor, which increase indicates contact between the probe and the formation.

19. The method of claim 12, further comprising limiting the force with the flow control device in response to a level of a property of the formation.

20. The method of claim 19, further comprising determining the level of the formation property downhole.

21. The method of claim 19, further comprising measuring the level of the formation property downhole with the formation tester.

22. The method of claim 12, further comprising controlling operation of the flow control device by a controller, and limiting the force applied by the probe with the controller in response to detection of contact between the probe and the formation by the position sensor.

23. The method of claim 12, further comprising controlling operation of the flow control device by a controller, and limiting the force applied by the probe by the controller based on a level of a property of the formation.

24. The method of claim 12, further comprising controlling operation of the flow control device by a controller, and limiting the force applied by the probe by the controller when in response to a decrease of the displacement rate of the probe.

25. A formation tester for use in a well located in a subterranean formation, comprising:

a probe extendable to contact the formation;

a piston connected to the probe and positioned in a housing comprising first and second chambers separated by the piston;

a pump coupled to and in fluid communication with the first and second chambers;

an adjustable flow control device coupled between and in fluid communication with the pump and the first chamber, wherein the adjustable flow control device is configured to limit an extension pressure applied to the first chamber for extending the probe;

a position sensor configured to measure a displacement rate of the probe;

a first solenoid valve coupled between the pump and the adjustable flow control device;

a second solenoid valve coupled between the pump and the second chamber;

a relief valve coupled to the pump and configured to prevent the pump from applying an excessive pressure to the first and second chambers; and wherein a force applied by the probe to the formation is remotely adjusted downhole in the well.

26. The formation tester of claim 25, wherein the adjustable flow control device comprises a servo-controlled valve and is remotely adjustable in the well.

27. The formation tester of claim 25, wherein the adjustable flow control device is in communication with the probe and configured to limit the extension pressure in response to detection of contact between the probe and the formation by the position sensor.

28. The formation tester of claim 25, wherein the adjustable flow control device is in communication with the probe and configured to limit the extension pressure in response to an increase in the extension pressure, which increase indicates contact between the probe and the formation.

29. The formation tester of claim 25, further comprising a pressure sensor, wherein the adjustable flow control device is configured to limit the extension pressure in response to a change in pressure sensed through the probe by the pressure sensor, which change indicates contact between the probe and the formation.

30. The formation tester of claim 25, wherein the adjustable flow control device is configured to limit the extension pressure in response to a level of a property of the formation.

31. The formation tester of claim 30, wherein the level of the formation property is determined downhole.

32. The formation tester of claim 30, wherein the formation tester is configured to measure the level of the formation property downhole.

33. The formation tester of claim 25, wherein the position sensor is configured to measure the displacement rate of the piston.

* * * * *